United States Patent [19]

House

[11] Patent Number: 5,040,789

[45] Date of Patent: Aug. 20, 1991

[54] GAME APPARATUS AND METHOD FOR PLAYING A GAME

[76] Inventor: Jimmy R. House, P.O. Box 157, Irondale, Mo. 63648

[21] Appl. No.: 573,469

[22] Filed: Aug. 27, 1990

[51] Int. Cl.[5] ..... A63F 9/00

[52] U.S. Cl. ..... 273/447; 273/58 D; 273/58 K; 273/449

[58] Field of Search ..... 273/1 GF, 1 GG, 58 D, 273/58 K, 424

[56] References Cited

U.S. PATENT DOCUMENTS

| | | | |
|---|---|---|---|
| 606,744 | 3/1897 | St. John | 273/239 |
| 2,226,912 | 12/1939 | Schenk | 273/1 GG |
| 2,985,451 | 12/1959 | Sims | 273/1 GF |
| 3,185,480 | 5/1965 | Weyman et al. | 273/424 X |
| 3,458,198 | 11/1965 | DeLucia et al. | 273/131 |
| 3,588,109 | 6/1971 | Gunderson | 273/1 GG X |
| 3,674,263 | 8/1972 | Villanueva | 273/1 R |
| 3,717,341 | 5/1973 | Blanton, Jr. | 273/1 G |
| 3,721,440 | 3/1973 | Burns | 273/1 GG |
| 3,887,182 | 12/1974 | Breslow | 273/1 R |
| 3,900,197 | 6/1975 | Inose | 273/1 R |
| 4,006,908 | 2/1977 | Minami | 273/58 D X |
| 4,248,424 | 2/1981 | Judkins | 273/58 K X |

*Primary Examiner*—Paul E. Shapiro

*Attorney, Agent, or Firm*—Senniger, Powers, Leavitt & Roedel

[57] ABSTRACT

Apparatus for a game including a game piece, a pair of long cylindrical implements having first and second ends, and a receptacle. The implements are held, one in each hand, by grasping the implements generally adjacent their first ends. The game piece has a first member with first and second opposite faces, a second member projecting outwardly from the first face of said first member, and a third member projecting outwardly from the second face of said first member. The members have thin outwardly facing peripheral edges. The general object of the game is to pick up the game piece by cooperatively engaging the implements adjacent their second ends with the thin peripheral edges of the game piece members and to deposit the game piece in the receptacle.

12 Claims, 1 Drawing Sheet

FIG. 1.
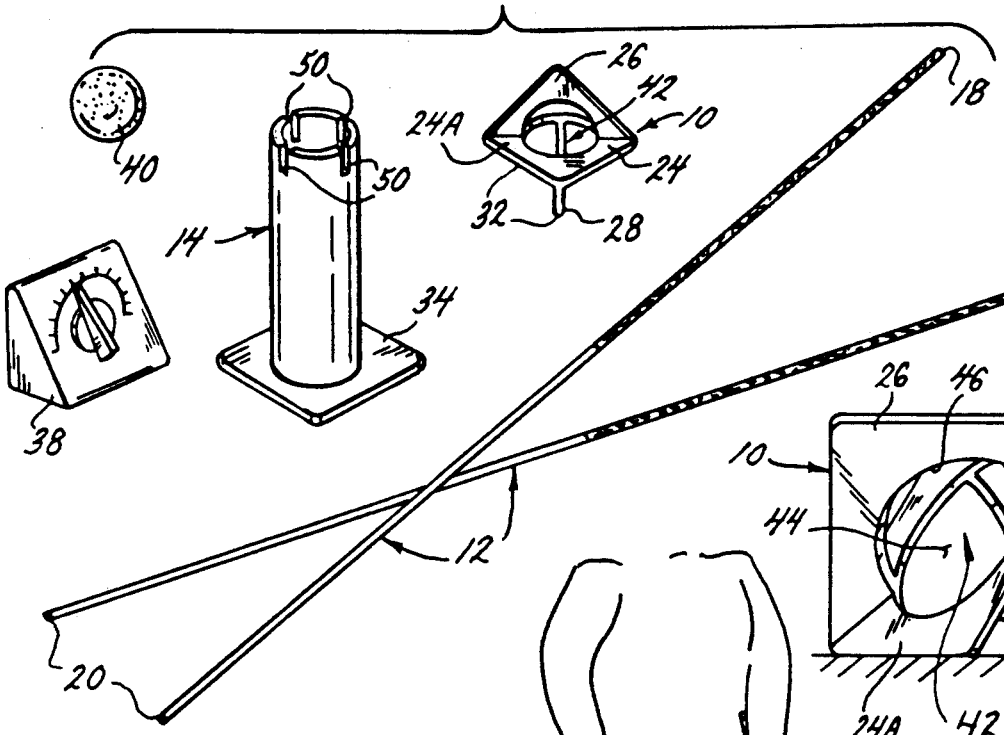
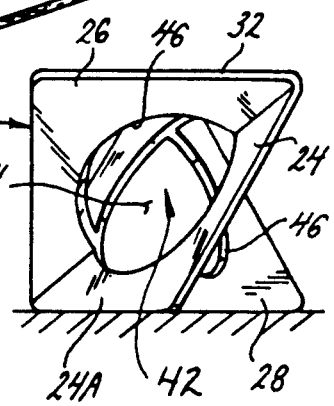
FIG. 4.
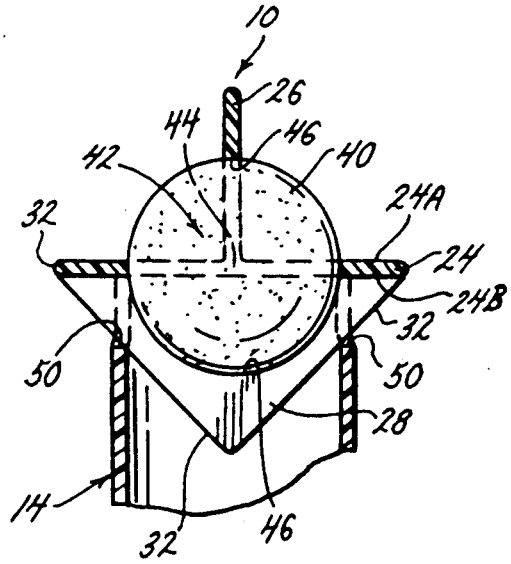
FIG. 3.
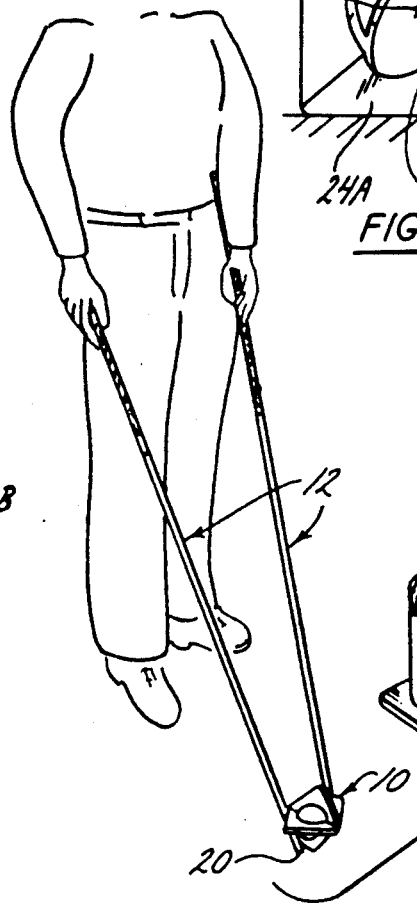
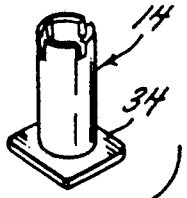
FIG. 2.

GAME APPARATUS AND METHOD FOR PLAYING A GAME

BACKGROUND OF THE INVENTION

This invention relates generally to games involving manipulation of a game piece with an implement and more specifically to a game in which a game piece is picked up by using a pair of long, cylindrical implements and transferred to a receptacle.

Reference is made to U.S. Pat. No. 2,985,451 and to U.S. Pat. No. 3,717,341, which disclose games involving the manipulation of game pieces with a pair of implements. Presently, games of the same general type as the present invention involve manipulation of a game piece of a simple symmetric geometric shape (e.g., a disc, a rectangular box, or a sphere) which are relatively easy to balance once they are picked up by the implements. Moreover, these games do not require that the game piece be held from falling by the implements as a player walks from the place where the game piece was picked up to the place where it is to be deposited. The receptacles for the game pieces of existing games are not configured to increase the difficulty in depositing the game piece in (or on) the receptacle. Finally, the there is no provision in existing games for selectively increasing the difficulty of manipulating the game piece.

SUMMARY OF THE INVENTION

Among the several objects of the present invention may be noted the provision of a game for one or more players which is both fun for children and yet improves their hand-eye coordination skills; the provision of such a game in which game pieces must be transferred by long cylindrical implements to a receptacle; the provision of such a game in which the game piece must be carefully oriented for deposit in the receptacle; and the provision of such a game in which a player is required to transfer the game piece to the receptacle in a limited amount of time.

Further among the objects of the present invention may be noted the provision of game apparatus in which the game pieces are constructed so as to make them difficult to manipulate with the implements; and the provision of such game apparatus which can be selectively configured to increase or decrease the difficulty with which the game piece may be manipulated by the implements.

Generally, apparatus for playing a game of the present invention comprises a game piece, a pair of long cylindrical implements having first and second ends, and a receptacle adapted to receive the game piece. The implements are adapted to be held, one in each hand, by grasping the implements generally adjacent their first ends. The game piece comprises a first member having first and second opposite faces, a second member projecting outwardly from the first face of said first member, and a third member projecting outwardly from the second face of said first member. Each of the members has thin outwardly facing peripheral edges. The general object of the game is to pick up the game piece by cooperatively engaging the implements adjacent their second ends with the thin peripheral edges of said members of the game piece, and to deposit the game piece in the receptacle.

Generally, a method for playing a game comprises the steps of providing the above described game apparatus, and grasping the pair of implements, one in each hand, generally adjacent their first ends. The implements are then manipulated by a player from a standing position to cooperatively engage the thin outwardly facing peripheral edges of the game piece with a portion of the implements adjacent their second ends. The game piece is lifted, using the implements, from the surface on which it rests. The player then walks, while supporting the game piece off the surface, from the initial location of the game piece on the surface to the receptacle, and deposits the game piece in the receptacle.

Other objects and features will be in part apparent and in part pointed out hereinafter.

BRIEF DESCRIPTION OF THE DRAWINGS

FIG. 1 is a perspective showing game apparatus of the present invention;

FIG. 2 is a perspective showing a player manipulating a game piece;

FIG. 3 is a fragmentary vertical section of a game piece as deposited in a receptacle; and FIG. 4 is an elevation of a game piece.

Corresponding reference characters indicate corresponding parts throughout the several views of the drawings.

DETAILED DESCRIPTION OF THE PREFERRED EMBODIMENTS

Referring now to the drawings, and in particular to FIG. 1, game apparatus of the present invention is shown to include a game piece 10, a pair of long, cylindrical implements or sticks 12 and a receptacle 14 adapted to receive the game piece. The sticks each have first and second ends indicated at 18 and 20, respectively, and, as shown in FIG. 2, are adapted to be held, one in each hand, by grasping the sticks generally adjacent their first ends 18. The game piece 10 includes a first member 24 having a first face 24A and a second face 24B opposite the first face. A second member 26 projects outwardly from the first face 24A of the first member and a third member 28 projects outwardly from the second face 24B of the first member. The members 24, 26, 28 all have thin, outwardly facing peripheral edges 32. The receptacle 14 is cylindrical and includes a base 34 at its lower end which rests on a playing surface, such as a floor F (FIG. 4). The upper end of the receptacle 14 is open for receiving a portion of the game piece 10. Although there are potentially many variations for playing a game using this apparatus in addition to the preferred methods of playing the game described below, the general object of the game is to pick up the game piece 10 using the sticks 12, as illustrated in FIG. 2, and deposit the game piece in the receptacle 14 (FIG. 3). The game apparatus may include, in an alternative embodiment, a timer 38 (broadly "timer means") for delimiting the time in which the game piece 10 may be legally transferred to the receptacle 14.

The sticks 12 and game piece 10 are made of a material, such as wood or plastic, which may be formed with a smooth outer surface so that there is little frictional engagement between the sticks and the game piece. Moreover, a game piece constructed according to the principles of the present invention is uniquely formed to increase the difficulty of picking up the game piece. To that end, the members 24, 26, 28 have been provided with the thin peripheral edges 32 which are engaged by the sticks 12 to pick up the game piece 10. The thin peripheral edges 32 provide a minimal surface area for engagement by the sticks 12.

In the preferred embodiment, the members 24, 26, 28 are thin and generally planar with the first member 24 being substantially square in plan, while the second and third members 26, 28 each have the shape of a right isosceles triangle one half the size of the first member. The members 24, 26, 28 may either be separately formed and then connected together, or integrally formed as a single piece. The second member 26 intersects the first face 24*a* of the first member at right angles, and the third member 28 intersects the second face 24*b* of the first member at right angles. The second and third members 26, 28 extend between diagonally opposite corners of the respective faces (24A or 24B) of the first member 24, such that the plane of the second member intersects the plane of the third member generally at right angles. The nonsymmetric arrangement of the second and third game members 26, 28 on opposite faces 24A, 24B of the first member 24 makes it more difficult to balance the game piece after it is picked up; thus increasing the skill required to transfer the game piece to the receptacle.

The difficulty in picking up the game piece 10 may be increased by the provision of a ball member 40 adapted to be releasably held by the game piece for increasing the weight of the game piece. The ball member 40 is made of resiliently deformable, sponge-like material. The game piece 10 has a seat, generally indicated at 42 for releasably holding the ball member 40. As shown in FIG. 4, the seat is formed by a circular opening 44 in the center of the first game piece member 24, and semicircular recesses 46 in the longest edge of each of the second and third game piece members 26, 28. The recesses 46 are symmetric about the midpoints of the longest edges of the second and third members, 26, 28. The radii of the opening 44 in the first member 24 and the semicircular recesses 46 in the second and third members 26, 28 are substantially the same, and the radius of the ball member 40 is slightly larger than the radii of the opening and recesses. The opening 44 and the recesses 46 define the seat 42 for the ball member 40. The ball member 40 may be inserted into the seat 42 by squeezing the ball member between one face of the first member 24 and either the second or third member (26 or 28). As the ball member 40 enters the seat 42, it expands outwardly toward its undeformed shape and engages the peripheral edges of the opening 44 and recesses 46 which define the seat. The portions of the ball member 40 contacting the game piece members 24, 26, 28 at the peripheral edges defining the seat 42 remain slightly deformed and hold the ball member in the seat by their engagement with the game piece members. It has been found that the when the ball member 40 is fitted into the game piece 10, it becomes more difficult to pick up the game piece with the sticks 12 because of the small, but finite addition of weight to the game piece by the ball member. Further, the presence of the ball member 40 adds to the decorative appearance of the game piece 10.

The method of playing the game of the present invention involves use of the game piece 10, the sticks 12 and the receptacle 14, as described above. To begin the game the receptacle 14 and the game piece 10 are placed on the floor F a distance apart from each other (e.g., eight feet). A player then grasps the sticks 12, one in each hand, generally at their first ends 18 and manipulates the sticks from a standing position, with the knees slightly flexed, so as to cooperatively engage the game piece 10 generally at its thin outwardly facing peripheral edges 32 with the portion of the sticks generally adjacent their second ends 20. The player lifts the game piece with the sticks 12 from the floor F. Should the game piece 10 be formed with a seat 42 for receiving the ball member 40, as described above, the rules of the game prohibit extending the sticks 12 through the opening 44 in the first member 24, or one of the recesses 46 in the second or third members. After the game piece 10 is lifted off the floor, it is deposited in the receptacle 14, that is; the player walks from the initial location of the game piece to the receptacle and, using the sticks 12, lowers the game piece in the receptacle. As may be seen in FIG. 1, upwardly opening slots 50 have been formed in the receptacle 14 at its upper end. The game piece 10 is to be placed into the open upper end of the receptacle 14 with portions of the peripheral edge margins adjacent the outwardly facing edges 32 of one of the game piece members 24, 26, 28 received in two of the slots 50 (FIG. 3). Thus further skill on the part of the player is required to properly orient the game piece 10 for deposit in the receptacle 14.

The other preferred methods of playing the game are described below. However, it should be noted that the potential for variations on the basic method of playing the game is limited only by the imagination of the players. One basic variation involves the additional step, prior to beginning to attempt to transfer the game piece to the scoring receptacle, of fitting the ball member 40 into its seat 42 to increase the difficulty of picking up the game piece 10 from the playing surface. Another variation involves use of the timer 38 described above to delimit the time the player has to transfer the game piece 10 from the playing surface to the receptacle 14. The provision of the timer 38 also allows the game to be played by one person. The object of the game would then be to attempt to pick up and deposit the game piece 10 as quickly as possible, competing against the times required in previous attempts. The timer 38 shown herein is a standard spring-operated mechanical timer which may be selectively set to mark the passage of several (e.g., one to five) minutes of time. However, other types of timers may be used and still fall within the scope of this invention. For instance, a more accurate timer, such as one indicating the passage of seconds, is preferred when players compete against the timer for the fastest time. Another method of involves the provision of multiple game pieces, pairs of sticks and receptacles, each like the game piece 10, pair of sticks 12 and receptacle 14 described above. In that embodiment, each of several players is provided with his or her own game piece 10, pair of sticks 12 and receptacle 14, which are color coordinated. For instance the portion of the sticks 12 adjacent their first ends 18 may be the same color as the game piece 10 and the receptacle base 34. The game pieces are each placed an equal distance away from their corresponding receptacles 14, and the players each attempt to be the first to transfer their game piece from its location on the playing surface to their receptacle. Still another method of playing the game allows the players to increase the difficulty as they master the game. Beginners may grasp the colored portions of the sticks 12 adjacent their first ends 18 as far as possible toward the second ends 20, without touching the uncolored portions of the sticks. Reducing the distance between the player's hands and the game piece 10 makes it easier to manipulate the game piece. As the players becomes more skilled, he or she grasps the sticks 12 farther toward their first ends 18, thereby increasing the difficulty of game piece manipulation.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. Apparatus for a game comprising in combination:

a game piece, a pair of long cylindrical implements having first and second ends, the implements being adapted to be held, one in each hand, by grasping the implements generally adjacent their first ends, and a receptacle, the game piece comprising a first member having first and second opposite faces, a second member projecting outwardly from the first face of said first member, and a third member projecting outwardly from the second face of said first member, said members having thin outwardly facing peripheral edges, the general object of the game being to pick up the game piece by cooperatively engaging the implements adjacent their second ends with the thin peripheral edges of said game piece members, and to deposit the game piece in the receptacle.

2. Game apparatus as set forth in claim 1 wherein said members are thin and generally planar.

3. Game apparatus as set forth in claim 2 wherein said second member intersects the first face of said first member generally at right angles, and said third member intersects the second face of said first member generally at right angles.

4. Game apparatus as set forth in claim 3 wherein the plane of said second member intersects the plane of said third member generally at right angles.

5. Game apparatus as set forth in claim 3 wherein said first member is substantially square in plan, and wherein said second and third members have the shape of right isosceles triangles which are each one half the size of said first member, said first and second members extending generally between diagonally opposite corners of said first game piece.

6. Game apparatus as set forth in claim 3 further comprising a ball member, and wherein the game piece is adapted to releasably hold the ball member.

7. Game apparatus as set forth in claim 1 further comprising timer means for delimiting the time in which the game piece may legally be picked up and deposited in said receptacle.

8. Game apparatus as set forth in claim 1 wherein the receptacle is cylindrical and has a base at its lower end and an open upper end adapted to receive a portion of the game piece therein, said receptacle having upwardly opening slots therein adjacent its upper end adapted to receive a marginal edge portion of said game piece members.

9. A method of playing a game comprising the steps of:

providing a game piece adapted to rest on a surface such as a floor, a pair of long cylindrical implements having first and second ends, and a receptacle, the game piece comprising a first member having first and second opposite faces, a second member projecting outwardly from the first face of said first member, and a third member projecting outwardly from the second face of said first member, said members having thin outwardly facing peripheral edges, grasping said pair of implements, one in each hand, generally adjacent the first end thereof, cooperatively engaging, from a standing position, the thin outwardly facing peripheral edges of the game piece members with a portion of the implements adjacent their second ends, lifting the game piece with the implements from the surface on which it rests, walking while supporting the game piece off the surface from the initial location of the game piece on the surface to a position generally adjacent said receptacle, and depositing the game piece in the receptacle.

10. A method as set forth in claim 9 wherein said step of depositing the game piece in the receptacle comprises the step of lowering the game piece from above the receptacle into the receptacle while positioning the game piece so that portions of peripheral edge margins of one of said game piece members are received in upwardly opening slots in the upper end of the receptacle.

11. A method as set forth in claim 9 further comprising the steps of:

providing timer means, and setting said timer means to delimit a predetermined period of time in which the game piece may be legally lifted from the surface and transferred to the receptacle.

12. A method as set forth in claim 9 further comprising the steps of:

providing a ball member made of resiliently deformable material, and, prior to the step of engaging the thin outwardly facing peripheral edges of the game piece with a portion of the implements adjacent their second ends, fitting the ball member into a seat in the game piece.

* * * * *